US007007435B2

(12) United States Patent
Ballantyne

(10) Patent No.: US 7,007,435 B2
(45) Date of Patent: Mar. 7, 2006

(54) DOOR STRUCTURE

(75) Inventor: Mark Ballantyne, Sacramento, CA (US)

(73) Assignee: American Building Supply, Inc., Sacramento, CA (US)

( * ) Notice: Subject to any disclaimer, the term of this patent is extended or adjusted under 35 U.S.C. 154(b) by 30 days.

(21) Appl. No.: 10/379,526

(22) Filed: Mar. 6, 2003

(65) Prior Publication Data

US 2004/0172906 A1 Sep. 9, 2004

(51) Int. Cl.
*E06B 3/70* (2006.01)

(52) U.S. Cl. ..... 52/455; 52/784.1

(58) Field of Classification Search ..... 52/455, 52/457, 784.1, 796.1, 784.11
See application file for complete search history.

(56) References Cited

U.S. PATENT DOCUMENTS

| | | | | |
|---|---|---|---|---|
| 635,341 | A | 10/1899 | Nash | |
| 2,399,666 | A | 5/1946 | Een | |
| 2,699,578 | A | 1/1955 | Marks | |
| 3,798,863 | A | 3/1974 | Latson | |
| 4,327,535 | A * | 5/1982 | Governale | 52/309.11 |
| 4,860,512 | A * | 8/1989 | Thorn | 52/309.11 |
| 5,737,890 | A | 4/1998 | Heyden | |
| 5,771,656 | A * | 6/1998 | Amoretti | 52/745.14 |
| 5,934,040 | A | 8/1999 | Chen | |
| 6,161,363 | A * | 12/2000 | Herbst | 52/784.15 |
| 6,311,454 | B1 * | 11/2001 | Kempel | 52/784.15 |
| 2002/0124497 | A1 | 9/2002 | Fortin | |

FOREIGN PATENT DOCUMENTS

| | | |
|---|---|---|
| WO | WO 02/31306 | 4/2002 |

* cited by examiner

*Primary Examiner*—Gwendolyn Baxter
(74) *Attorney, Agent, or Firm*—Theodore J. Bielen, Jr.

(57) ABSTRACT

A door structure utilizing a first skin having a surface. The first skin also includes an aperture through the same. A second skin is similarly constructed to the first skin such that the aperture of the second skin aligns at least partially with the aperture of the first skin. A panel is sandwiched between the first and second skin surfaces by first and second adhesive layers, respectively. The panel is positioned to at least partially occlude the apertures of the first and second skins.

6 Claims, 4 Drawing Sheets

DOOR STRUCTURE

BACKGROUND OF THE INVENTION

The present invention relates to a novel and useful panel door structure.

Doors are typically assembled from multiple components, such as stiles, which extend vertically and one or more rails, which traverse a pair of stiles to form a frame. Panels are often placed within this frame by the use of interlocking mortises and tenons and muntins which interpose the stiles. Generally, mechanical fasteners are then employed to retain the plurality of elements into a unitary door. The door is then finished according to esthetic criteria and installed with hardware such as hinges, door knobs, latches, locks, and the like.

Although doors have been traditionally constructed of wood, newer materials have proven satisfactory as a substitute for wood in this regard. For example, fibrous materials known as high-density fiber (HDF), medium density fiber (MDF), low-density fiber (LDF), and the like have been employed for this purpose.

In addition, newer methods of finishing involving relatively high heating processes have been applied to windows and doors. For example, powder coating is a preferred finish that is environmentally safe and is extremely durable. Unfortunately, conventionally assembled wooden doors are not amenable to powder coating since the interlocking elements and the fasteners employed in the construction of the door tend to separate upon the application of heat.

In the past, many doors have been devised from components which are fixed together using hardware such as screws, nails, clips, and the like. For example, U.S. Pat. Nos. 635,341, 2,699,578, 3,798,863, 5,737,890, and 6,311,454 illustrate doors of such construction.

U.S. Pat. No. 2,399,666 shows a reinforced door having a core insulating material. The door is held together by mechanical fasteners.

U.S. Patent Publication 2002/0124497 A1 describes a fire resistant door edge in which intumescent material is formed into a strip covered by an edge. The composite assembly is held together by a screw.

International Publication WO 02/31306 A1 describes a fire door in which intumescent material is placed along the edges of a door which is assembled using threaded fasteners.

U.S. Pat. No. 5,934,040 teaches a snap-together molded door in which foam is used as the core and pigment is provided in the material forming the portions of the door.

Panel door structure which is formed as a unitary member without mechanical fasteners, would constitute a notable advance in the construction arts.

BRIEF SUMMARY OF THE INVENTION

In accordance with the present invention a novel and useful panel door structure is herein provided.

The structure of the present invention utilizes a first skin. The first skin possesses a top portion, a bottom portion, and first and second opposite side portions and may be described as a first skin unit. The first skin unit also includes an aperture therethrough which spans first and second opposite surfaces.

A second skin is also found in the present invention and includes a top portion, a bottom portion, and first and second side portions. The second skin unit constructed in this manner is similar to the first skin unit and possesses an aperture therethrough between first and second surfaces. The apertures of the first and second skin units are positioned in overlying relationship to one another such that at least a portion of the apertures align.

The invention also provides for at least one panel having a first surface and an opposite second surface. The panel is sandwiched between the first and second skin units such that at least a portion of the panel is visible through the apertures of the first and second skin units.

A first adhesive layer interposes the first skin second side and at least a portion of the panel first side. A second adhesive layer is used to bind the second skin unit first side in at least a portion of the panel's second side. The first and second adhesive layers hold the first skin unit second skin unit and panel together as a door structure.

In certain instances the panel may be formed to underlie only a portion of the first and second skin units. The first and second skin units may be dadoed or grooved to accommodate such structure.

Where, the panel positions between the first and second skin units and extend to the edges of the same, a stile may be employed. Such stile may lie along one or more of the edges of the structure of the present invention in combination with the first and second skin units and the panels sandwiched therebetween. In such a situation, the structure of the present invention would include a third adhesive layer between portions of the first and second skin units as well as adhesive layers between the stile and the first and second skin units. The stile may be composed of a material such as wood to allow hardware, such as hinges, to be securely fastened to the structure of the present invention.

The panel may take various design formats, including relieved portions, depressed portions and the like. Such features are visible through the apertures of the first and second skin units and may lie on either side of the panel i.e. on the first and second surfaces thereof. In addition, the panel may be composed of translucent material and assume a outline visible through the apertures of the first and second skin units following an angular pattern or curved format. Such appearance is defined by the shape of the apertures of the first and second skin units, permitting the panel to be formed in a conventional rectangular, curved, or square shape.

In addition, the panel of the present invention may include a core of fire resistant or intumescent material. Such layer of intumescent material may extend from the core of the panel to an area between the first and second skin units, when the panel itself does not extend to the edges of the first and second skin units.

It may be apparent that a novel and useful panel door structure has been hereinabove described.

It is therefore and object of the present invention to provide a panel door structure which does not require the use of dowels or fasteners and, thus, eliminates seams in a finished door structure.

Another object of the present invention is to provide a panel door structure which eliminates stile and rail separation problems found in conventional doors using mechanical fasteners.

Yet another object of the present invention is to provide a panel door structure which allows hinge attachment when the panel door is constructed primarily of fiber material.

A further object of the present invention is to provide a panel door structure which permits finishing options which require relatively high temperature methods to accomplish.

Another object of the present invention is to provide a panel door structure which is economical to manufacture.

Yet another object of the present invention it to provide a panel door structure which minimizes gaseous emissions of volatile components during the manufacture and finishing thereof.

Another object of the present invention is to provide a panel door structure which may be manufactured in a short length of time by elimination of assembly and finishing steps.

Another object of the present invention is to provide a panel door structure which is versatile in allowing designs of panels to be quickly and easily determined.

Another object of the present invention is to provide a panel door structure which is easily "squared" and exhibits higher rigidity than doors of the prior art.

Another object of the present invention is to provide a panel door structure which may be manufactured using reduced tolerances.

Another object of the present invention is to provide a panel door structure which may be manufactured with fire resistance characteristics.

The invention possesses other objects and advantages especially as concerns particular characteristics and features thereof which will become apparent as the specification continues.

For a better understanding of the present invention reference is made to the following detailed description of the preferred embodiments which should be taken in conjunction with the prior described drawings.

DETAILED DESCRIPTION OF THE PREFERRED EMBODIMENTS OF THE INVENTION

Various aspects of the invention will evolve from the following detailed description of the preferred embodiments thereof which should be referenced to the prior delineated drawings.

Figure 1:
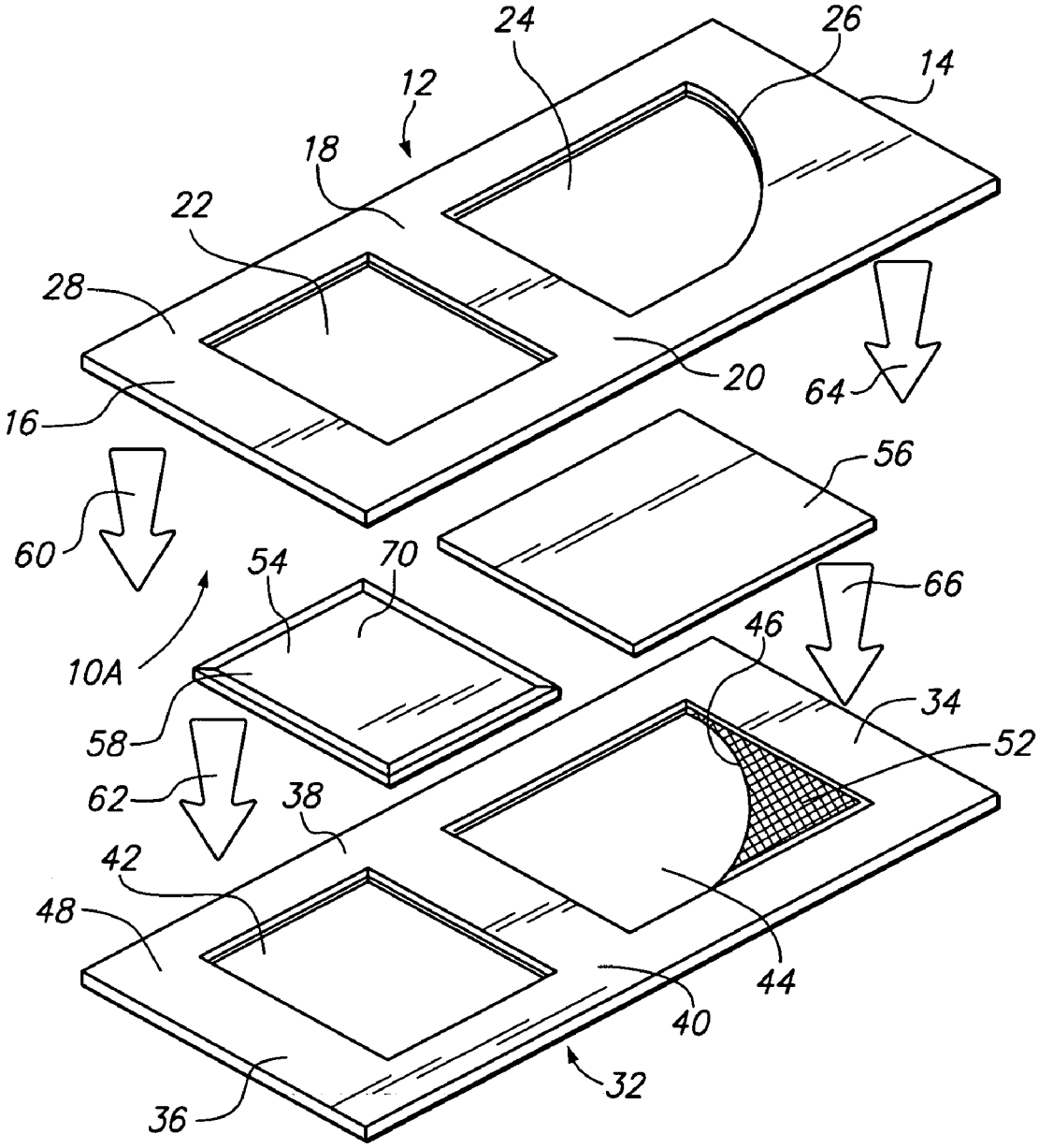
FIG. 1 is an exploded view showing and embodiment of the panel door of the present invention.
Figure 2:
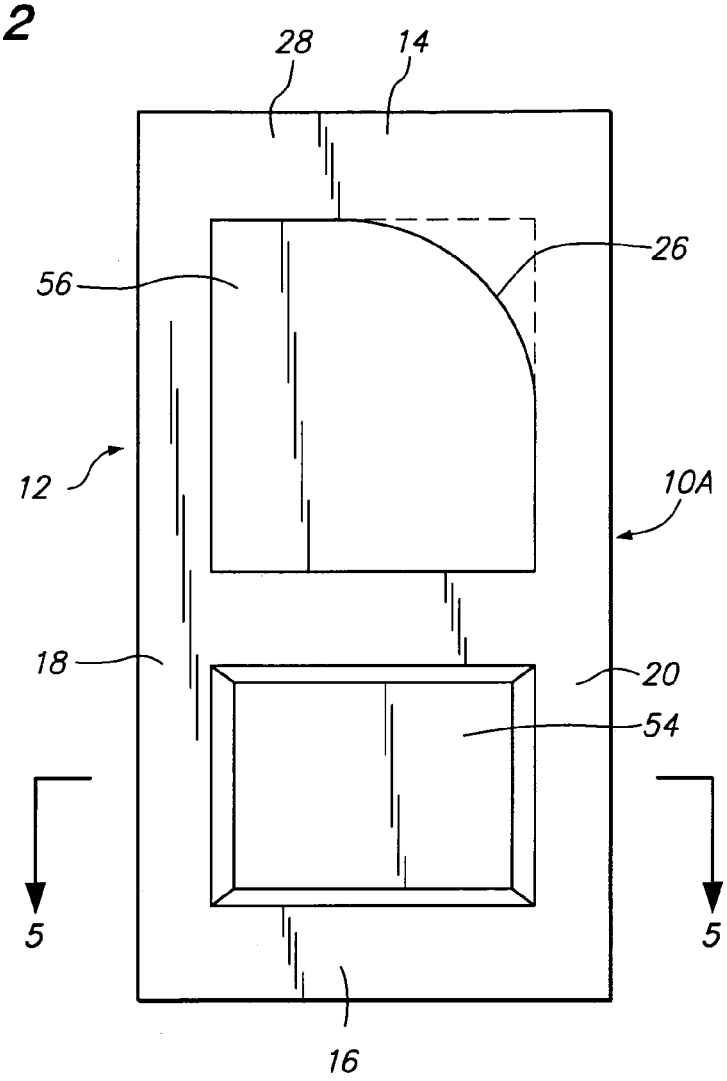
FIG. 2 is a front elevational view depicting the assembled panel door of the present invention.

The preferred embodiment of the invention as a whole is shown in the drawings by reference character 10 followed by an upper case letter to denote variations thereof. With reference to FIGS. 1 and 2, embodiment 10A of the panel door structure of the present invention is depicted. Structure 10A includes as one of its elements a first skin unit 12. First skin unit 12 possesses a top portion 14, first side portion 18, and second side portion 20. Apertures 22 and 24 extend through first skin unit 12. It should be noted that aperture 24 possesses a curved edge 26. In addition, first skin unit 12 includes first surface 28 and an opposite second surface 30, FIG. 5.

A second skin unit 32 is also provided having a top portion 34, bottom portion 36, first side portion 38, and second side portion 40. Apertures 42 and 44 extend through second skin unit 32. Aperture 44 includes a curved edge 46 similar in configuration to edge 26 of aperture 24 of first skin unit 12. Second skin unit also possesses first surface 48 and second surface 50, FIG. 5. Second skin unit 32 also possesses a recessed or dadoed area (cross-hatched) 52 away from curved edge 46.

Figure 3:
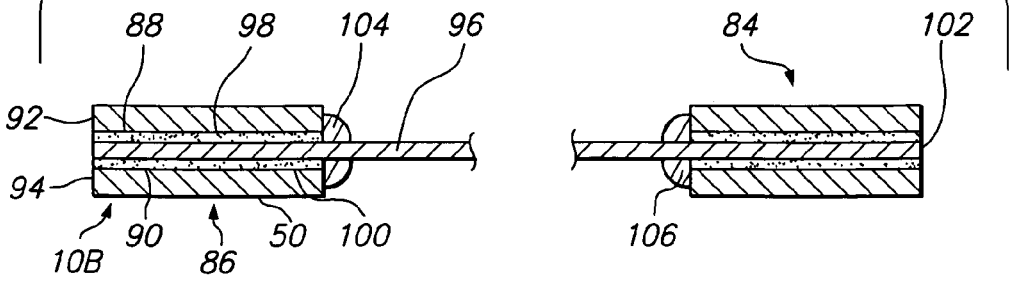
FIG. 3 is a sectional view similar to that of FIG. 5 showing a first alternate embodiment of the present invention.
Figure 5:
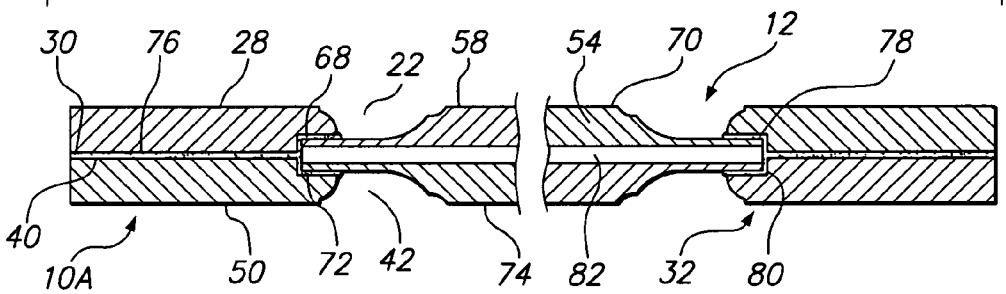
FIG. 5 is a sectional view taken along line 5—5 of FIG. 2.

Structure 10A, FIGS. 1, 3, and 5, also require panels 54 and 56. Panel 54 includes a centrally raised or relieved portion 58. It should be understood that panel 54 may include other designs, reliefs, depressions and the like for the sake of esthetics. Panel 56 is shown as a rectangular plate. Panel 56 fits within aperture 46 and atop recessed portion 52 heretofore described. It should be noted that panel 54 or 56 may be formed of any suitable material, including translucent items such as glass, plastics, and the like.

It may be observed in FIG. 1, directional arrows 60, 62, 64, and 66 show that first skin unit and second skin unit sandwich panels 54 and 56 therebetween to the embodiment shown in FIG. 2. With reference to FIG. 5, it may be observed that apertures 24 and 44 of first and second skin units, respectively, align. In addition, apertures 22 and 42 of first skin unit 12 and second skin unit 32 correspondingly aligned in this sandwiched configuration. Thus, panels 54 and 56 are visible when door structure 10A is assembled as shown in FIG. 2. It should be apparent that panel 56 appears to have a curved edge defined by curved edge 26 of first skin 12. A similar appearance would be found on the reverse side of door 10A depicted in FIG. 2 (not shown) by curved edge 46 of second skin unit 32.

Referring now to FIG. 5, it should be seen that a first adhesive layer 68 interposes first skin unit 12 and the first side 70 of panel 54. Likewise, a second adhesive layer 72 interposes second skin unit 32 and second side 74 of panel 54. In addition, a third adhesive layer 76 lies between skin unit 12 and skin unit 32 beyond the extension of panel 54 in embodiment 10A illustrated in FIG. 5. First and second adhesive layers 68, 72 are optional in the present invention. In many cases, adhesive layers 68 and 72 are omitted to allow for panel shrinkage or expansion due to moisture. It should be realized, that first skin unit 80 includes a groove or dado 78 while second skin unit 32 includes a groove or dado 80 complementary to dado 78. Dadoes 78 and 80 form an open chamber to engage panel 54 and hold adhesive layers 68 and 72 therewithin. In certain cases only one of the skin units need to be dadoed to produce a panel door structure. It should also be noted that panel 54 includes a core 82 which may be composed of insulative or fire resistant material.

Referring now to FIG. 3, it may be observed that another embodiment 10B of the present invention is depicted. Panel door structure 10B includes a first skin unit 84 and a second skin unit 86, similarly constructed to skin units 12 and 32 of FIG. 5. Skin units 84 and 86 include surfaces 88 and 90 respectively which face one another. Skin units 84 and 86 include edges 92 and 94, respectively, which extend completely around skin units 84 and 86. Although skin units 84 and 86 are shown as having similar thicknesses, such skin units may be employed with different thicknesses. Channel 96 lies between skin units 84 and 86 and is held in place by adhesive layers 98 and 100. Thus, the edge 102 of panel 96 lies flush with edges 92 and 94 of first and second skin units 84 and 86, respectively. Decorative moldings 104 and 106 lie between first and second skins 84 and 86, respectively, and panel 96 for the sake of esthetics.

Figure 4:
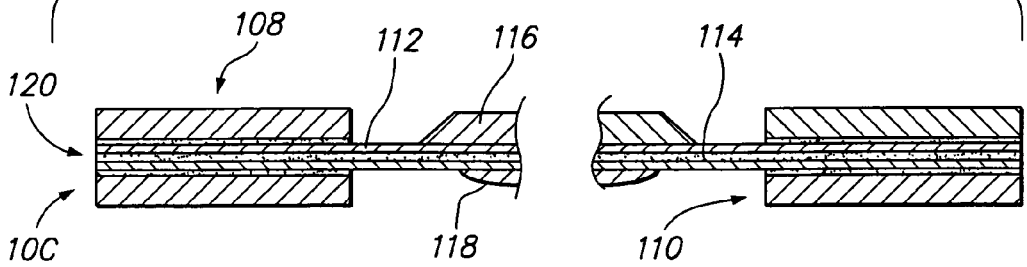
FIG. 4 is a sectional view similar to that of FIG. 5 showing a second alternate embodiment of the present invention.

FIG. 4 represents another embodiment 10C of the present invention in which first skin unit 108 and second skin unit 110 are employed to sandwich panel 112 therebetween in a manner similar to that depicted in FIG. 3. However, panel 112 includes core 114, which may be of fire resistant or intumescent material. Raised portions 116 and 118 embellish panel 112. Core material 114 extends to edge portion 120 of panel door 10C and may expand outwardly therefrom should a fire occur in that area. Such expansion is intended to cause a seal in a doorframe where panel door 10C has been installed.

Figure 6:
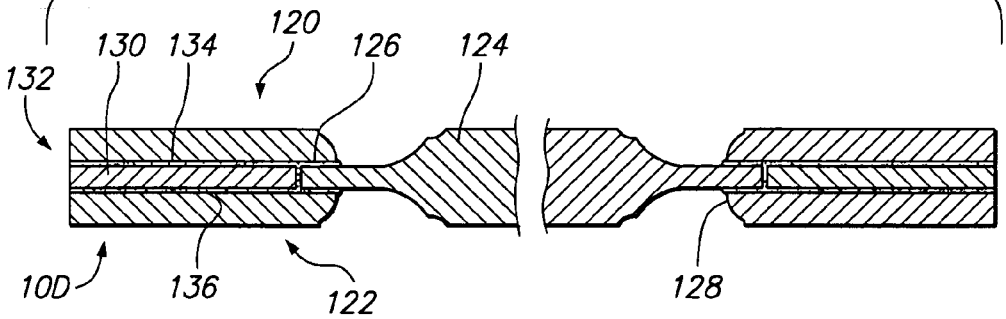
FIG. 6 is a sectional view similar to that of FIG. 3 showing a third alternate embodiment of the present invention.

Looking now at FIG. 6, another embodiment 10D of the present invention is shown. Panel door 10D possesses a first skin unit 120 and a second skin unit 122 in opposition to the same. Panel 124 lies between a portion of first skin unit 120 and second skin unit 122. Optional adhesive layers 126 and 128 hold panel 124 to skin layers 120 and 122. A filler or spacer 130 extends between panel 124 and edge portion 132 of panel door 10D. Filler 130 is held in such position by adhesive layers 134 and 136.

Figure 7:
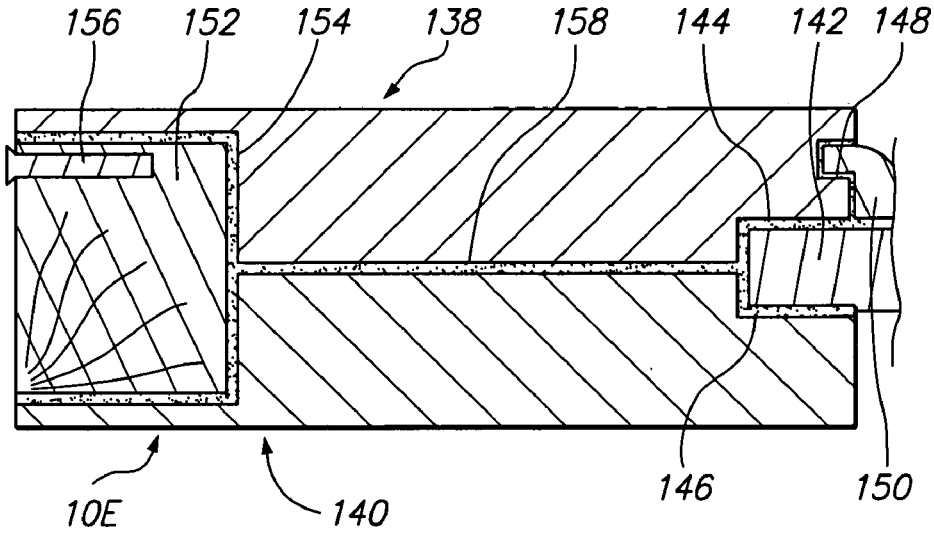
FIG. 7 is a sectional view of a portion of the structure of a fourth embodiment of the present invention indicating the use of a stile.

Referring now to FIG. 7, embodiment 10E is shown. 10E is formed with a first skin unit 138 and an opposing second skin unit 140. Panel 142 lies between skins 138 and 140 and is held in that position by adhesive layers 144 and 146. Adhesive layer 148 holds sticking piece 150 to skin unit 138 and to panel 142. Embodiment 10E of the panel door of the present invention is also formed with a wooden stile 152 by the use of an adhesive layer 154 which contacts skin units 138 and 140. A metallic fastener 156 is illustrated in FIG. 7 to indicate the attachment of hardware such as hinges and panel door 10E. It also should be noted that adhesive layer 158 interposes first skin unit 138 and second skin unit 140 to form a unitary door member.

Figure 8:
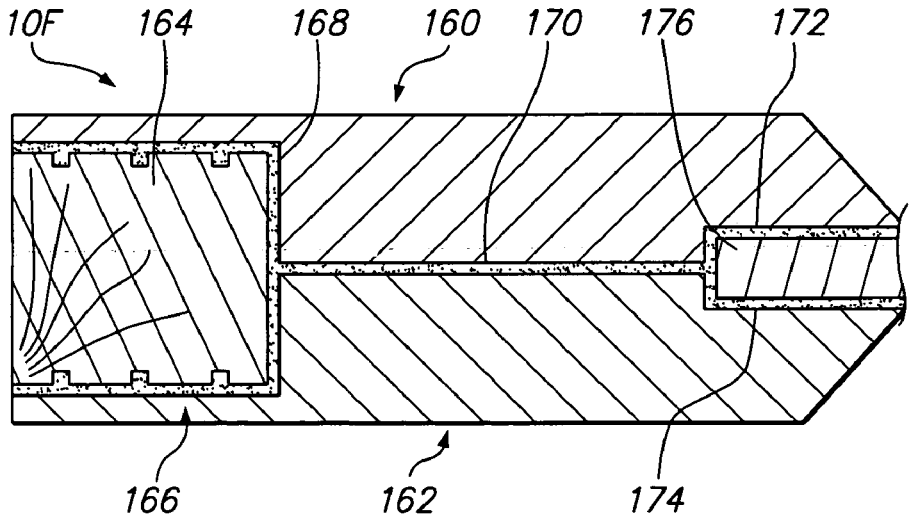
FIG. 8 is a sectional view of a portion of a fifth embodiment the door structure of the present invention showing the use of a stile which is a variation of the stile depicted in FIG. 7.

Viewing now FIG. 8, it may be observed that skin units 160 and 162 are used in embodiment 10F of the present invention. Skin units 160 and 162 are employed with a stile 164 which is preferably constructed of wood. Stile 164 includes plurality of recesses or crevices 166 to hold adhesive from adhesive layer 168 which interposes stile 164 and skin units 160 and 162. Optional adhesive layers 170, 172, and 174 bind panel 176 to skin units 160 and 162, respectively.

The adhesive layers described in embodiments 10A–10F may be of any suitable type, compatible with fibrous type material such as HDF, MDF, and LDF. Polyvinyl acetate has been found to be a suitable adhesive, in this regard.

In operation, panel door 10A is assembled by sandwiching panels 54 and 56 between skin units 12 and 32 as depicted in FIG. 1, adhesive layers 68 and 72 hold panels, such as panel 54, to skin units 12 and 32, FIG. 5. Adhesive layer 76 also adheres skin units 12 and 32 together. A similar assembly is undertaken to produce the panel doors 10B–10F. The result is a sturdy, easily squared panel door which is susceptible to a variety of finishing methods, such as powder coating, since there is no separation of components or seams during such finishing process which normally requires a high level of heat.

While in the foregoing, embodiments of the present invention have been set forth in considerable detail for the purposes of making a complete disclosure of the invention, it may be apparent to those of skill in the art that numerous changes may be made in such detail without departing from the spirit and principles of the invention.

What is claimed is:

1. A panel door structure, comprising:

a. a first skin, said first skin including a top portion, a bottom portion, and first and second side portions forming a first skin unit, said first skin unit including an aperture therethrough, a first surface, and an opposite second surface, said first skin unit further including an edge portion at the termini of said first and second sides thereof;

b. a second skin, said second skin including a top portion a bottom portion, and first and second side portions forming a second skin unit, said second skin unit including an aperture therethrough, a first surface, and an opposite second surface, said aperture of said first skin unit positioned in overlying relationship with said aperture of said second skin unit, said second skin unit further including an edge portion at the termini of said first and second sides thereof;

c. a panel, said panel including a first surface and an opposite second surface, said panel being sandwiched between said first skin unit and said second skin unit to permit visibility of at least a part of said panel first surface through said aperture of said first skin unit, and to permit visibility of said panel second surface through said aperture of said second skin unit, said panel including an edge extending to the edge of the first skin unit and the edge of the second skin unit, said edge of said first skin unit, said second skin unit, and said panel forming the edge of the door structure; and d. an adhesive layer interposing said first skin unit second side portion and said second skin unit first side portion, said adhesive layer holding said first skin unit, said second skin unit, and said panel together.

2. The structure of claim 1 in which said panel first surface further includes a relieved portion.

3. The structure of claim 1 in which said panel second surface further includes a relieved portion.

4. The structure of claim 1 in which said panel includes a translucent portion.

5. The structure of claim 1 which further comprises said panel including a core of fire rated material.

6. The structure of claim 1 in which said adhesive layer comprises a first adhesive layer between said first skin unit second side portion and said panel first side portion, and further comprises a second adhesive layer between said second skin unit first side portion and said panel second side portion, said first and second adhesive layers holding said first skin unit, said second skin unit, and said panel together.

* * * * *